US006811351B1

(12) United States Patent
Schroeder

(10) Patent No.: US 6,811,351 B1
(45) Date of Patent: Nov. 2, 2004

(54) SELF ALIGNING MECHANICAL POINTER

(75) Inventor: James C. Schroeder, Ramsey, MN (US)

(73) Assignee: Graco Inc., Minneapolis, MN (US)

( * ) Notice: Subject to any disclaimer, the term of this patent is extended or adjusted under 35 U.S.C. 154(b) by 0 days.

(21) Appl. No.: 09/980,981

(22) PCT Filed: Apr. 19, 2000

(86) PCT No.: PCT/US00/10566

§ 371 (c)(1),
(2), (4) Date: Oct. 18, 2001

(87) PCT Pub. No.: WO00/63029

PCT Pub. Date: Oct. 26, 2000

Related U.S. Application Data

(60) Provisional application No. 60/130,023, filed on Apr. 19, 1999.

(51) Int. Cl.[7] ..... E01C 23/16; B05C 5/00

(52) U.S. Cl. ..... 404/93; 404/94

(58) Field of Search ..... 404/93, 94; 118/713

(56) References Cited

U.S. PATENT DOCUMENTS 2,076,370 A * 4/1937 Hollingshead ..... 404/94
2,633,382 A * 3/1953 Dudley et al. ..... 239/165
2,660,791 A * 12/1953 Howell ..... 33/41.6
2,975,979 A * 3/1961 Shaffer ..... 239/150
4,267,973 A * 5/1981 Stewart ..... 239/73
4,624,602 A * 11/1986 Kieffer et al. ..... 404/94
4,893,751 A * 1/1990 Armstrong ..... 239/150
4,962,892 A * 10/1990 Sauer ..... 239/722
5,302,207 A * 4/1994 Jurcisin ..... 118/713
5,772,359 A * 6/1998 Marty ..... 404/94
5,951,201 A * 9/1999 Jones ..... 404/94
6,079,114 A * 6/2000 Toews ..... 33/624
6,698,774 B2 * 3/2004 Duncan ..... 280/63

* cited by examiner

*Primary Examiner*—Robert E. Pezzuto
*Assistant Examiner*—Raymond W Addie
(74) *Attorney, Agent, or Firm*—Douglas B. Farrow

(57) ABSTRACT

A self-aligning mechanical pointer (10), includes a frame (12) attached to the front of a vehicle (14). A guide wheel (16) rides on a road surface and is rotatably carried by a wheel holder (18). The wheel holder (18) is connected to a swing arm (20), which pivots on frame (12) at point (22). An adjustable linkage member (24) connects swing arm (20) to a second swing arm (26). A guide rod (28) provides a sight means for an operator to align the pointer (10) with an intended target.

1 Claim, 3 Drawing Sheets

SELF ALIGNING MECHANICAL POINTER

This application claims the benefit of provisional application Ser. No. 60/130,023, filed Apr. 19, 1999.

TECHNICAL FIELD

This invention is designed for use with vehicle mounted line stripers.

BACKGROUND ART

While various types of video and mechanical guidance systems are known for use with vehicle mounted line stripers, all systems known to date suffer somewhat with rear mounted stripers in that while attempting to stripe over an existing line. While cornering, the front of the vehicle must track slightly to the outside of the line in order to keep the paint guns on the existing lines.

DISCLOSURE OF THE INVENTION

A pivoting wheel rides on the road surface and is connected to a swing arm with an adjustable linkage to another swing arm supporting a vertical rod which acts as a line guide.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
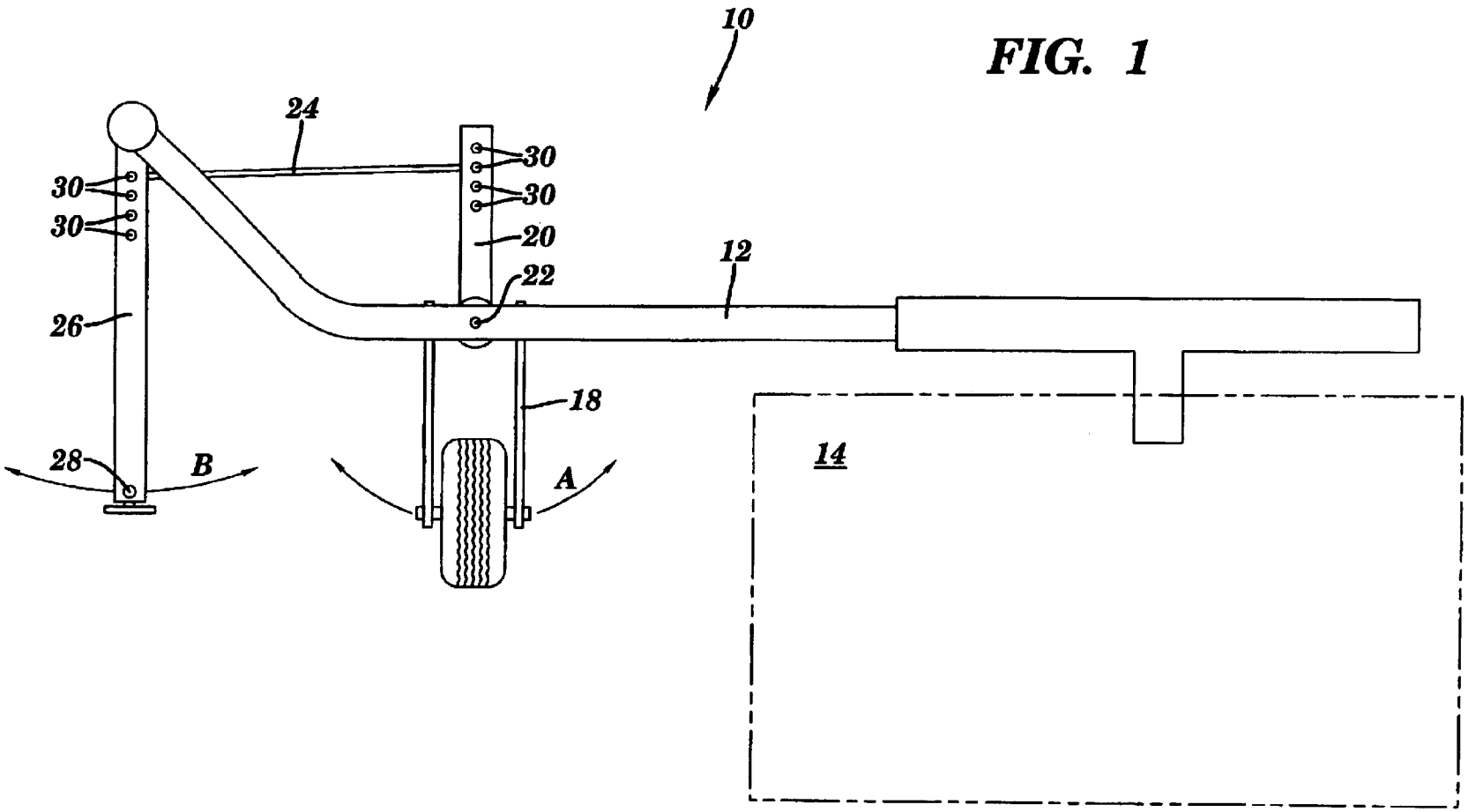
FIG. 1 is a lop plan view of the guidance system of the instant invention.
Figure 2:
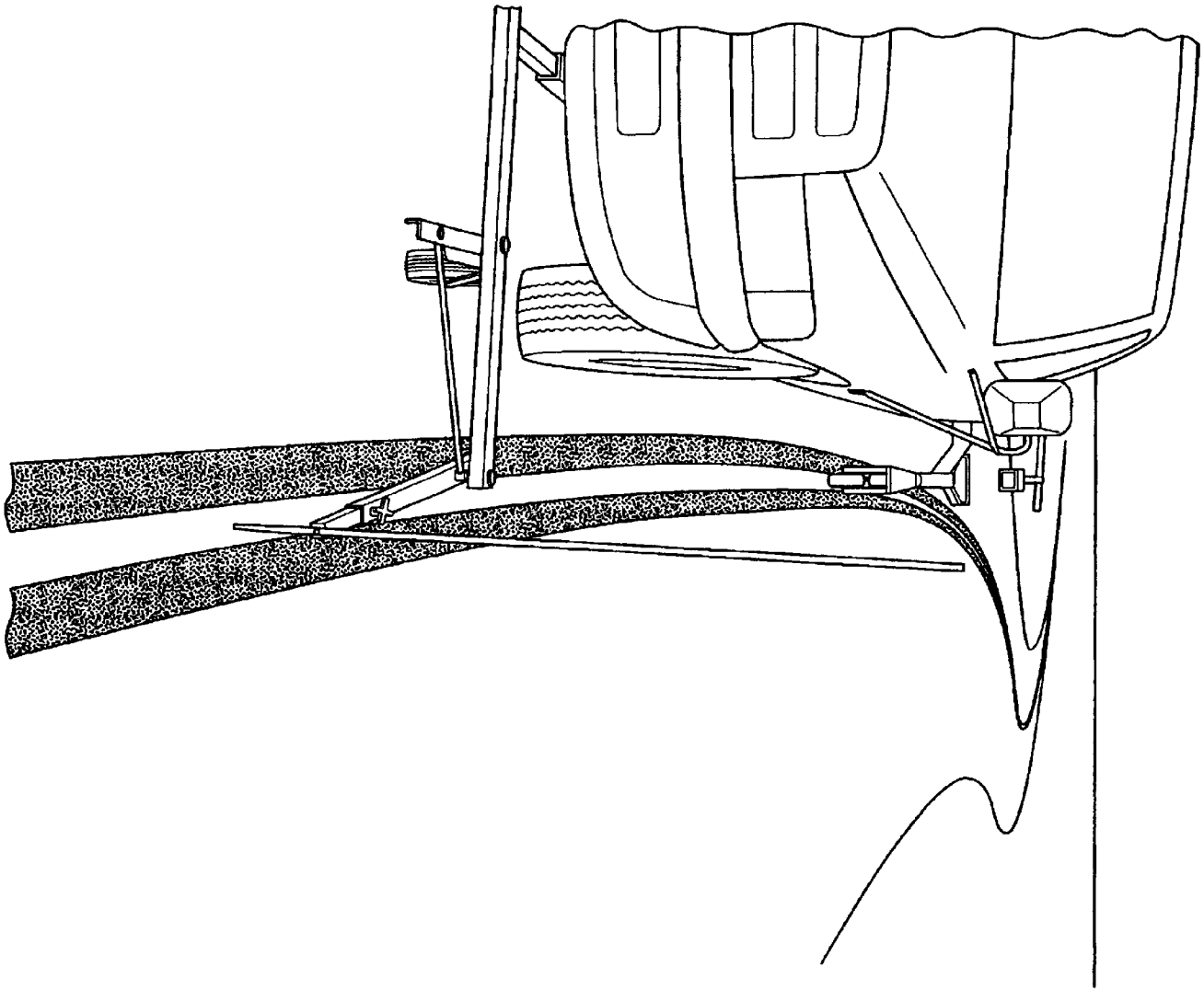
FIG. 2 is a front perspective view showing the guidance system mounted to a vehicle with the guide rod tracking the preexisting line.
Figure 3:
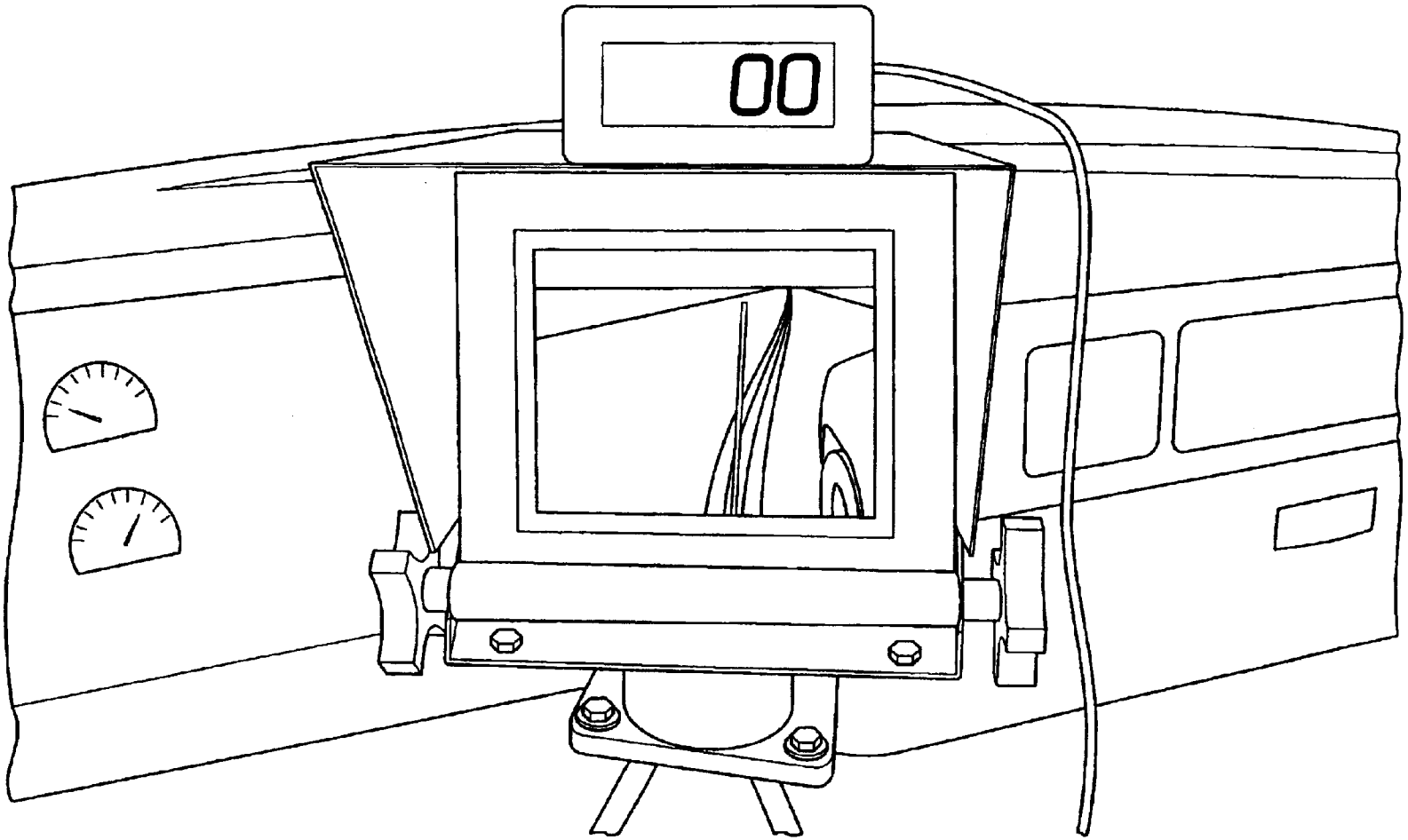
FIG. 3 is an operator's view from inside the vehicle cab showing the guide rod following the line on a forward looking video system.

The instant invention is generally designated 10 and shows a frame 12 attached to the front of a vehicle 14. A guide wheel 16 rides on the road surface and is rotatably carried by a pivoting wheel holder 18. Wheel holder 18 is connected to a swing arm 20, both of which pivot on frame 12 at pivot point 22. An adjustable linkage member 24 connects first swing arm 20 to second swing arm 26 supporting a vertical guide rod 28 which acts as a line guide. Second swing arm 26 is pivotably mounted to the end of frame 12. As can be seen in FIG. 1, first and second swing arms 20 and 26 respectively each have a plurality of adjustment holes which allow the geometry of the linkage to be adjusted to suit a variety of vehicles and guidance systems.

As shown in the drawings, the instant invention is designed for use with the forward looking guidance system sold by Graco Inc., assignee of the instant invention for use with the ROAD LAZER™ line striper. In operation, the operator need merely maintain the guide rod 28 with the line on which striping is desired (preexisting or otherwise).

It is contemplated that various changes and modifications may be made to the guidance system without departing from the spirit and scope of the invention as defined by the following claims.

What is claimed is:

1. A guidance system for use with a vehicle-mounted line striper, said guidance system comprising:

a frame for mounting on said vehicle;

a first guide arm pivotably attached to said frame so as to pivot around a generally vertical axis;

a second guide arm pivotably attached to said frame so as to pivot around a generally vertical axis and said first guide arm;

a ground-contacting guide wheel rotatably mounted to said first guide arm said first guide arm and said guide wheel being mounted so as to pivot and follow the an intended path of said vehicle during operation; and a guide rod extending vertically upwardly from said second guide arm so that the operator of said vehicle may maintain said guide rod on a line to be striped so as to maintain proper placement of said line through curves.

* * * * *